US009151464B2

(12) United States Patent
Farchtchian et al.

(10) Patent No.: US 9,151,464 B2
(45) Date of Patent: Oct. 6, 2015

(54) LIGHT SOURCE UNIT, AN ILLUMINATING DEVICE EQUIPPED WITH THE LIGHT SOURCE UNIT AND MEDICAL EQUIPMENT

(71) Applicant: OSRAM AG, Munich (DE)

(72) Inventors: Nadir Farchtchian, Berlin (DE); Al Ma, Guangdong (CN); Nico Morgenbrod, Berlin (DE)

(73) Assignee: OSRAM GmbH, Munich (DE)

( * ) Notice: Subject to any disclaimer, the term of this patent is extended or adjusted under 35 U.S.C. 154(b) by 102 days.

(21) Appl. No.: 13/645,524

(22) Filed: Oct. 5, 2012

(65) Prior Publication Data

US 2013/0100643 A1 Apr. 25, 2013

(30) Foreign Application Priority Data

Oct. 20, 2011 (CN) ..... 2011 1 0321987

(51) Int. Cl.

| | |
|---|---|
| ***F21V 9/00*** | (2015.01) |
| ***F21V 9/08*** | (2006.01) |
| ***F21V 7/00*** | (2006.01) |
| ***F21V 7/04*** | (2006.01) |
| ***F21V 7/06*** | (2006.01) |
| *F21W 131/205* | (2006.01) |
| *F21Y 101/02* | (2006.01) |
| *F21Y 105/00* | (2006.01) |
| *F21Y 113/00* | (2006.01) |
| *F21V 13/02* | (2006.01) |

(52) U.S. Cl.

CPC ..... *F21V 7/0033* (2013.01); *F21V 7/041* (2013.01); *F21V 7/06* (2013.01); *F21V 13/02* (2013.01); *F21W 2131/205* (2013.01); *F21Y 2101/02* (2013.01); *F21Y 2105/003* (2013.01); *F21Y 2113/00* (2013.01); *F21Y 2113/005* (2013.01)

(58) Field of Classification Search

CPC ..... F21V 3/0463; F21V 7/0033; F21V 7/06; F21V 7/041; F21V 13/02; F21Y 2113/005; F21Y 2105/003; F21Y 2101/02; F21Y 2113/00; F21W 2131/205

USPC ..... 362/84, 231, 800, 555, 551, 311.02, 362/296.08

See application file for complete search history.

(56) References Cited

U.S. PATENT DOCUMENTS

| | | | | |
|---|---|---|---|---|
| 5,287,731 | A * | 2/1994 | Florkowski et al. | 73/53.05 |
| 7,821,194 | B2 * | 10/2010 | Negley et al. | 313/498 |
| 8,018,135 | B2 | 9/2011 | Van De Ven et al. | |
| 2002/0080622 | A1 * | 6/2002 | Pashley et al. | 362/555 |
| 2005/0063185 | A1 | 3/2005 | Monjo et al. | |
| 2008/0239697 | A1 * | 10/2008 | Katsuda et al. | 362/33 |
| 2008/0304260 | A1 * | 12/2008 | Van De Ven et al. | 362/231 |
| 2011/0090669 | A1 * | 4/2011 | Sun et al. | 362/84 |
| 2012/0305953 | A1 | 12/2012 | Bertram et al. | |

FOREIGN PATENT DOCUMENTS

| | | | |
|---|---|---|---|
| EP | 1389710 | A2 | 2/2004 |
| EP | 1462711 | A1 | 9/2004 |
| WO | 2011038948 | A1 | 4/2011 |

* cited by examiner

*Primary Examiner* — Stephen F Husar
*Assistant Examiner* — Naomi M Wolford

(57) ABSTRACT

The present invention relates to a light source unit having at least one LED sub light source unit. Each LED sub light source unit includes three types of LEDs: phosphor converted green LED, orange-red LED with a wavelength of 614 nm-622 nm, and blue LED with a wavelength of 460 nm-476 nm. Light generated by the three types of LEDs is mixed to generate white light.

14 Claims, 6 Drawing Sheets

LIGHT SOURCE UNIT, AN ILLUMINATING DEVICE EQUIPPED WITH THE LIGHT SOURCE UNIT AND MEDICAL EQUIPMENT

RELATED APPLICATIONS

This application claims priority to Chinese Application No. 201110321987.3 filed on Oct. 20, 2011, the content of which is incorporated by reference in its entirety herein.

FIELD OF THE DISCLOSURE

The present invention relates to a light source unit. In addition, the present invention further relates to an illuminating device with the light source unit and medical equipment.

BACKGROUND

The traditional illuminating devices for operation theatre lighting use either halogen or discharge lamps as light source. Light from various lamps is reflected onto a big reflector via an optical device and subsequently focused onto an area to be illuminated. More recently, color and white LED based illuminating devices have been utilized.

In the prior art, a variety of light emitting diodes (LED) are used as light sources inside an operation theatre lighting device. However, none of the existing fixtures are able to generate and provide the illumination area with a homogeneously distributed white lighting with adjustable correlated color temperature (CCT), high color rendering index (CRI) and high optical efficiency. Furthermore, existing prior art technology could not remedy the color separation (also called discoloration) effect that typically occurs when a person (i.e. a surgeon) obscures the light from the fixture with his or her body parts.

SUMMARY

Various embodiments provide a light source unit, an illuminating device equipped with such light source unit and medical equipment for solving the problems in the prior art. The light source unit according to various embodiments can render a high luminous efficiency and adjustable white light of a good quality with a Correlated Color Temperature (CCT) between 3580K and 5650K, with no color separation effects on the illumination area. Furthermore, using fewer numbers of LEDs and only three reflectors may reduce the cost of the system.

Various embodiments provide a light source unit that comprises at least one LED sub light source unit, wherein each LED sub light source unit comprises three types of LEDs, i.e., phosphor converted green LED having CIE 1931 color location coordinates in the range x=0.35 to 0.39 and y=0.42 to 0.54, orange-red LED with an emission wavelengths in the range between 614 nm and 622 nm and blue LED with a emission wavelengths in the range between 460 nm and 476 nm, and light generated by the three types of LEDs is mixed to generate white light. Various embodiments provide rendering light of a high quality and luminous efficiency by choosing LEDs of specific types and specific wavelengths. Based on experimental data, the inventors surprisingly found that, when the three types of LEDs, i.e., phosphor converted green LED having CIE 1931 color location coordinates in the range x=0.35 to 0.39 and y=0.42 to 0.54, with a preferred range of x=0.36 to 0.38 and y=0.43 to 0.46, orange-red LED with a wavelength of 614 nm-622 nm and blue LED with a wavelength of 460 nm-476 nm, are combined, the best luminous effect can be obtained, a CCT can be adjusted between 3580K and 5650K, and a Color Rendering Index CRI value can reach 90 or higher. The phosphor converted green LED employs a blue light emitting chip and a green conversion phosphor in order to generate light with CIE 1931 color location coordinates in the range x=0.35 to 0.39 and y=0.42 to 0.54

In various embodiments, the three types of LEDs are arranged such that light is uniformly mixed for all Correlated Color Temperatures (CCT) in the range between 3580K and 5650K. The three types of LEDs may be arranged according to this principle.

In various embodiments, considering the luminance value of light, each LED sub light source unit comprises 27 LEDs including 15 phosphor-converted green LEDs, seven orange-red LEDs and five blue LEDs. In various embodiments, the 27 LEDs are arranged as follows: a vertical column formed by three LEDs in a center, an inner ring surrounding the vertical column, and an outer ring surrounding the inner ring, wherein the vertical column includes a green LED in the middle, and a blue LED and an orange-red LED respectively on the top and at the bottom; eight green LEDs are distributed on the inner ring with two green LEDs forming a row with the green LED in the middle; and four blue LEDs, six green LEDs and six orange-red LEDs are distributed on the outer ring with one green LED between two orange-red LEDs and one orange-red LED between two green LEDs being arranged alternatively between each two blue LEDs. By means of such arrangement, a uniform mixing is obtained. In various embodiments, the arrangement above may be realized considering using OSRAM LUW CQDP EQW with CIE 1931 color coordinates of x=0.37 and y=0.44 as the phosphor-converted green LED, OSRAM LB CPDP as the blue LED and the OSRAM LA CPDP as the orange-red LED. Alternatively, the OSRAM LCG Q9WP with CIE 1931 color coordinates of x=0.33 and y=0.53 can be used.

In various embodiments, each LED has a light emergent angle bigger than 140°. A better mixing effect can be achieved by selecting the LED with a big light emergent angle. For this purpose, the LED may be comprised of one or many light emitting chips with attached primary optics, for example a lens.

In various embodiments, a maximum ratio of green luminous flux of the green LEDs can reach 90%, a maximum ratio of blue luminous flux of the blue LEDs can reach 10%, and a maximum ratio of amber luminous flux of the orange-red LEDs can reach 15%. The percentage expresses the ratio of the luminous flux of the respective light components (i.e. phosphor-converter green LEDs, blue LEDs, and orange-red LEDs) to the total luminous flux of the entire illumination device resulting in a specific CCT. The correlated color temperature of the light source can be adjusted by proper distribution of the ratios of light intensities of the used LEDs.

An illuminating device that can comprise other light sources or the light source unit according to the present application is further provided according to various embodiments.

In various embodiments, the illuminating device comprises a light source unit, an optical device, a first reflector and a second reflector, wherein light from the light source unit is incident upon the first reflector after mixed and collimated by the optical device, and incident upon the second reflector after reflected by the first reflector, to form a converged light column for a region to be illuminated after reflected by the second reflector. Different from a prior LED illuminating device, the illuminating device with such structure has a reduced number of optical devices, a small light loss by means of the first reflector and the second reflector provided, re-alizes a focusing complying with usage requirements and has a good spot performance.

In various embodiments, the optical device is a hollow reflector enclosing the light source unit and having an inner reflection wall. Different light from the light source unit, after totally reflected and mixed in the hollow reflector, is output from an output end of the hollow reflector in a form of light column, to be further projected onto the first reflector and the second reflector. Such optical device for collimation has a low cost, which significantly reduces the cost.

In various embodiments, the hollow reflector is a total reflection type optical concentrator. Such collimating unit also has a good mixing function when light sources of multiple colors or different spectrum performances are used. The hollow reflector is a hollow reflection rod enclosing the light source unit and having a hexagonal cross section, so as to particularly advantageously match with the arrangement of respective LEDs and realize a good mixing effect.

In various embodiments, the first reflector is downstream the optical device in a direction of an optical axis of light and is arranged to be opposite to the optical device.

In various embodiments, the first reflector has a cone-like reflective surface rotationally symmetric with respect to the optical axis of the light, and a peak of the cone-like reflective surface is pointed to the light source unit, so as to give spots with sharp sidelines in the region to be illuminated.

In various embodiments, the second reflector is a paraboloid type reflector enclosing the light source unit so as to better focus the light in the region to be illuminated.

The light source comprises of LEDs mounted on a printed circuit board (PCB), preferably with aluminum or copper substrate. This PCB is connected via a thermal pad or thermal conductive paste to the heat sink, which is embedded in the corpus of the light head embedding the illuminating device.

In various embodiments relate to medical equipment equipped with the illuminating device having the above features.

The light source unit and illuminating device have the advantages such as a high luminous efficiency, uniform light mixing and a Color Rendering Index (CRI) of equal or greater than 90 for the correlated color temperature (CCT) range 3580K to 5650K.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

Figure 1:
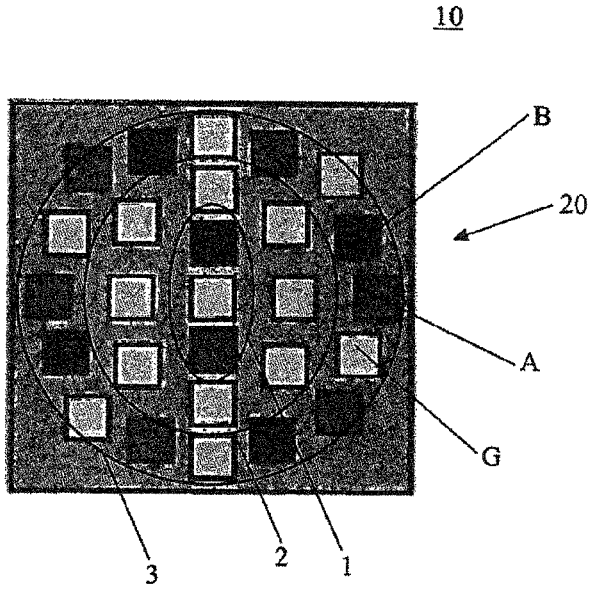
FIG. 1 is a local schematic diagram of a light source unit according to an embodiment.

FIG. 1 is a local schematic diagram of a light source unit 10 according to one exemplary embodiment of the present invention. The light source unit 10 is formed by three types of LEDs, i.e., orange-red LED A, phosphor converted green LED G and blue LED B. In order to produce a resulting white light with Correlated Color Temperatures between 3580K to 5650K, the inventors have carried out a lot of experiments for determining the best combination mode, including determining the number of types of the LEDs, specific types of the LEDs, wavelength combination of the LEDs, etc. In experiments, the inventors surprisingly found that the white light with Correlated Color Temperatures between 3580K and 5650K can be obtained and a high luminous efficiency and a high CRI value of equal or greater than 90 can be obtained when three types of LEDs, i.e., phosphor converted green LED G, orange-red LED A with emission wavelengths in the spectral range 614 nm to 622 nm and blue LED B with emission wavelengths in the spectral tange between 460 nm and 476 nm, are combined.

Arrangement of the LEDs shown in FIG. 1 is a preferred embodiment. A general principle of the arrangement is to enable various types of LEDs A, G and B to be arranged in a manner that light can be uniformly mixed when used in the illuminating device 100 (as described in FIG. 5) in the CCT range of 3580K-5650K. In this embodiment, each LED sub light source unit 20 comprises 27 LEDs including 15 green LEDs G, seven orange-red LEDs A and five blue LEDs B. The 27 LEDs are arranged as follows: a vertical column 1 in the middle, an inner ring 2 surrounding the vertical column 1, and an outer ring 3 surrounding the inner ring 2, wherein the vertical column 1 includes three LEDs, i.e., a green LED G in the middle, a blue LED B on the top and an orange-red LED A at the bottom; eight phosphor-converted green LEDs G are distributed on the inner ring 2 with two green LEDs G forming a row with the green LED in the middle; and four blue LEDs B, six green LEDs G and six orange-red LEDs A are distributed on the outer ring 3 with one green LED G between two orange-red LEDs A and one orange-red LED A between two green LEDs G being arranged alternatively between each two blue LEDs B, that is, one orange-red LED A is arranged between two green LEDs G at the lower left corner and the top right corner, and one green LED G is arranged between two orange-red LEDs A at the top left corner and the lower right corner. Preferably, OSRAM LUW CQDP EQW can be chosen as the phosphor-converted green LED G, OSRAM LB CPDP as the blue LED B (470 nm) and OSRAM LA CPDP as the orange-red LED A.

An LED with a light emergent angle bigger than 140° may be used in order to give a high light intensity. For this purpose, the LED may be comprised of one or many light emitting chips with attached primary optics, for example a lens.

In the whole CCT range of 3580K-5650K, a maximum ratio of green luminous flux of the green LEDs G can reach 90% of the total luminous flux, a maximum ratio of blue luminous flux of the blue LEDs B can reach 10% of the total luminous flux, and a maximum ratio of red luminous flux of the orange-red LEDs A can reach 15% of the total luminous flux. Of course, for each specific embodiment the ratios add up to a total of 100%. Table 1 provides an overview about the LED mixing ratios for the specified Correlated Color Temperatures CCT. The table also lists the achievable CRI and R9 values. The phosphor-converted green LEDs have color coordinates of x=0.37 and y=0.45.

TABLE 1

| CCT | Orange-Red 620 nm | Converted green | Blue 472 nm | CRI | R9 |
|---|---|---|---|---|---|
| 3600K | 12.50% | 86.1% | 1.4% | 92 | 93 |
| 3800K | 11.80% | 86.0% | 2.2% | 94 | 96 |
| 4200K | 10.60% | 86.0% | 3.4% | 96 | 97 |
| 4500K | 9.40% | 86.6% | 4.0% | 96 | 94 |
| 4800K | 8.60% | 86.8% | 4.6% | 95 | 92 |
| 5200K | 7.90% | 86.6% | 5.5% | 95 | 93 |
| 5600K | 7.10% | 86.7% | 6.2% | 95 | 92 |

Figure 2:
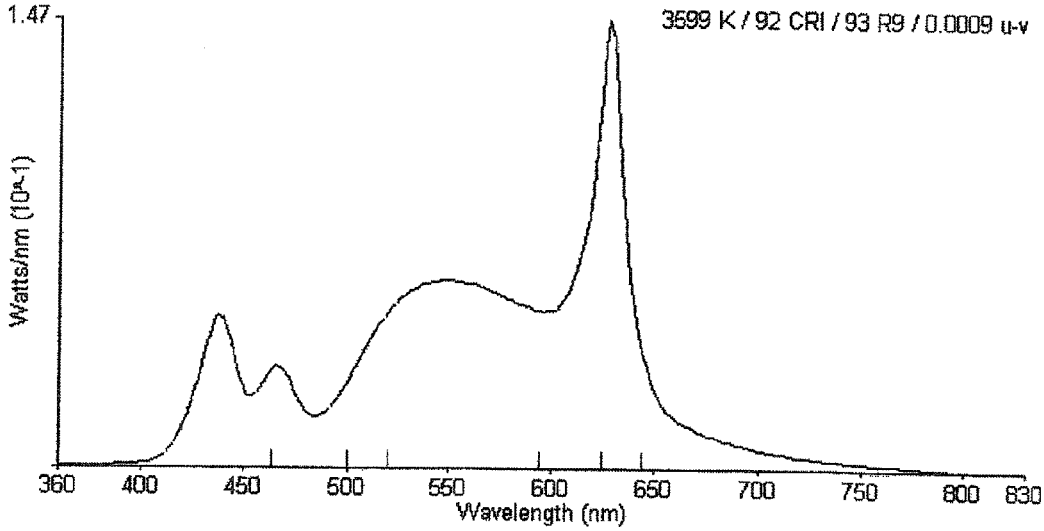
FIG. 2 shows a typical spectrum according to various embodiments with a CCT of 3599 K, a CRI value of 92, and an R9 value of 93.

FIG. 2 shows a typical spectrum according to the invention with a CCT of 3599 K, an CRI value of 92, and an R9 value of 93. The same LEDs were used as in Table 1.

Figure 3:
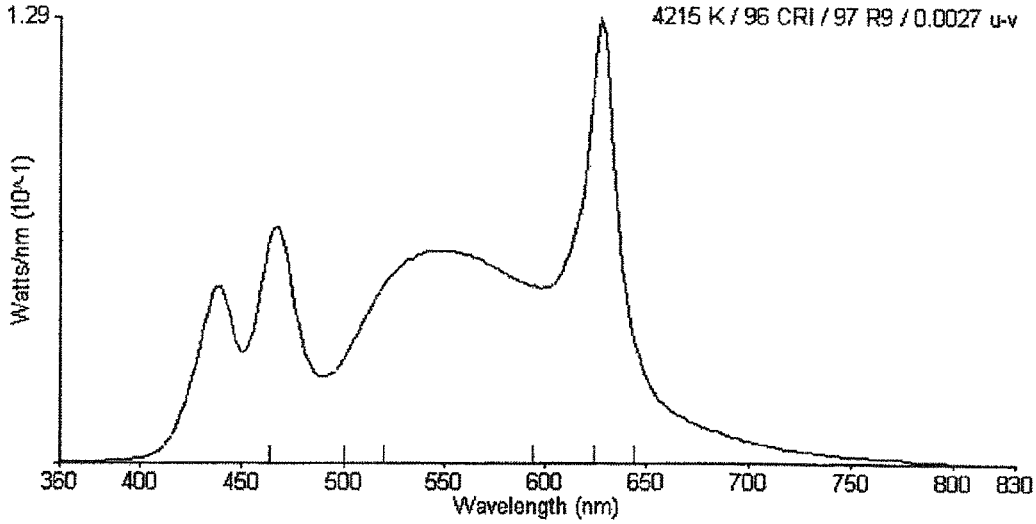
FIG. 3 shows a typical spectrum according to various embodiments with a CCT of 4215 K, a CRI value of 96, and an R9 value of 97.

FIG. 3 shows a typical spectrum according invention with a CCT of 4215 K, an CRI value of 96, and an R9 value of 97. The same LEDs were used as in Table 1.

Figure 4:
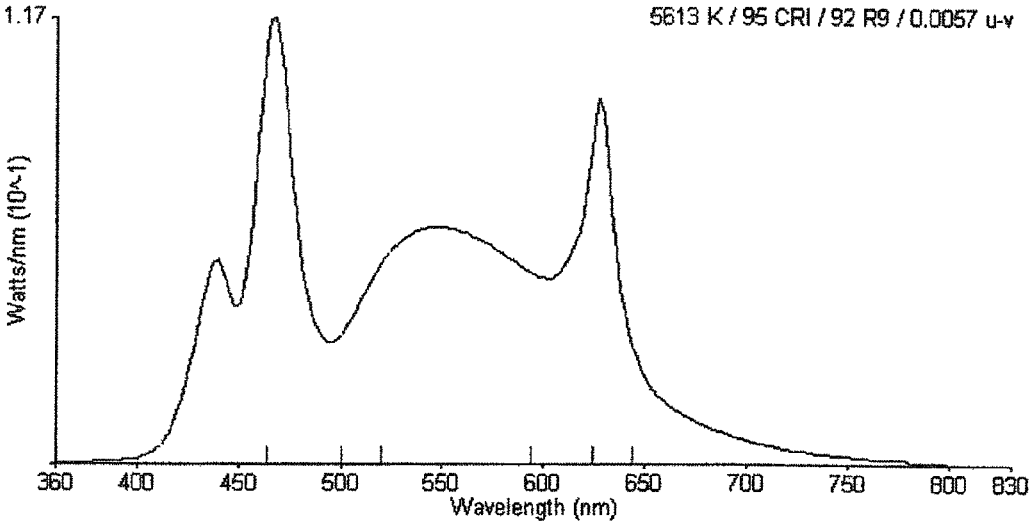
FIG. 4 shows a typical spectrum of various embodiments with a CCT of 5613 K, a CRI value of 95, and an R9 value of 92.

FIG. 4 shows a typical spectrum of the claimed invention with a CCT of 5613 K, an CRI value of 95, and an R9 value of 92. The same LEDs were used as in Table 1.

Figure 5:
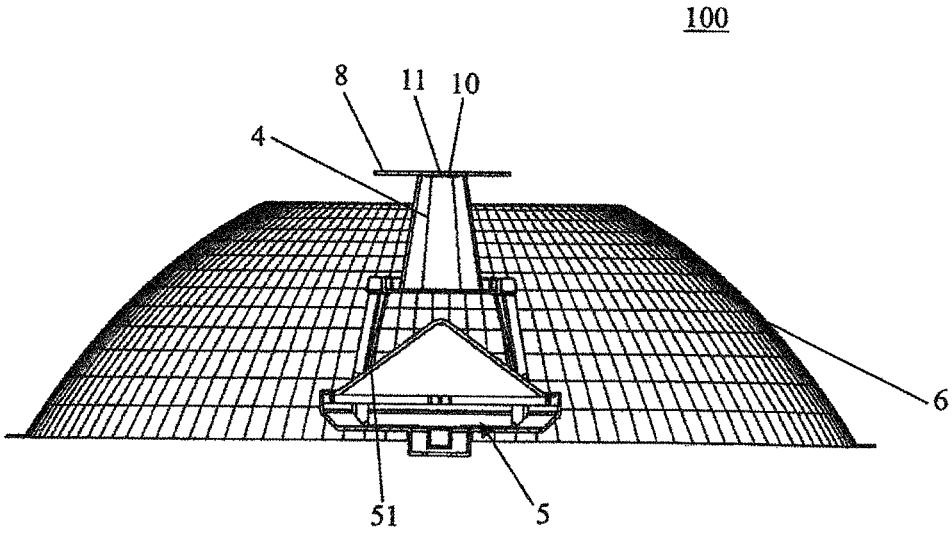
FIG. 5 is a local schematic diagram of an illuminating device according to an embodiment.

FIG. 5 is a local schematic diagram of an illuminating device 100 according to one exemplary embodiment of the present invention. As can be seen from the figure, the light source unit 10 is arranged in an optical device 4 that has functions of collimating and mixing light. The optical device 4 is a hollow reflection rod enclosing the light source unit 10 and having a hexagonal cross section (see FIG. 6), so that light emitted from respective LEDs is fully mixed and directions of the light are tuned onto a first reflector 5. Alternatively, the optical device may be a total inner reflection (TIR) type collimating lens or a TIR optical concentrator. The first reflector 5 is located in the middle of an optical path and in a position opposite to the light source unit 10 so as to receive light emitted from the light source unit 10. The first reflector 5 is configured to be rotationally symmetric, and preferably, it is configured to have a conic-like outer reflective surface 51 so that the light from the light source 10 can be reflected symmetrically onto a second reflector 6. The second reflector 6 is also configured to be rotationally symmetric and has an inner reflective surface 61 for enclosing the first reflector 5 (see FIGS. 7*a*-7*b*). The LEDs are placed on a Printed Circuit Board 11 that is attached to a heat sink (not shown)

Figure 6:
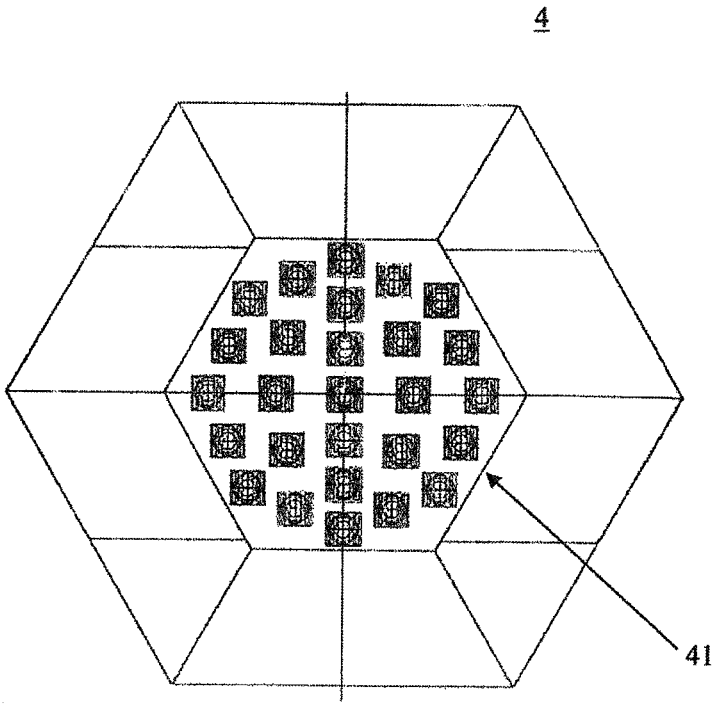
FIG. 6 is a local sectional view of an optical device and a light source according to an embodiment.

FIG. 6 is a local sectional view of the optical device 4 and the light source 10 in the illuminating device 100 according to one exemplary embodiment of the present invention. As can be seen from FIG. 7*c*, the optical device 4 is a hollow reflection rod that encloses the light source unit 10 and has a hexagonal cross section, so as to provide six inner reflective surfaces 41 as inner walls, and the hexagonal cross section is also adapted to the arrangement of the 27 LEDs of the light source unit 10. The hollow reflection rod may be configured to be elongated in order to mix the light as fully as possible.

Figure 7A:
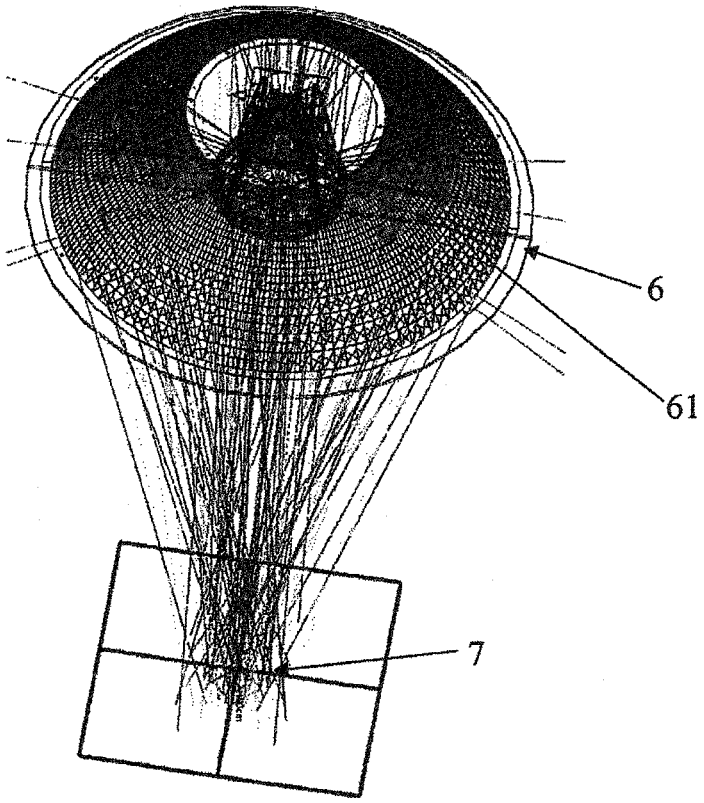
FIG. 7*a* and FIG. 7*b* are diagrams of a general optical path of an illuminating device according to an embodiment.
Figure 7B:
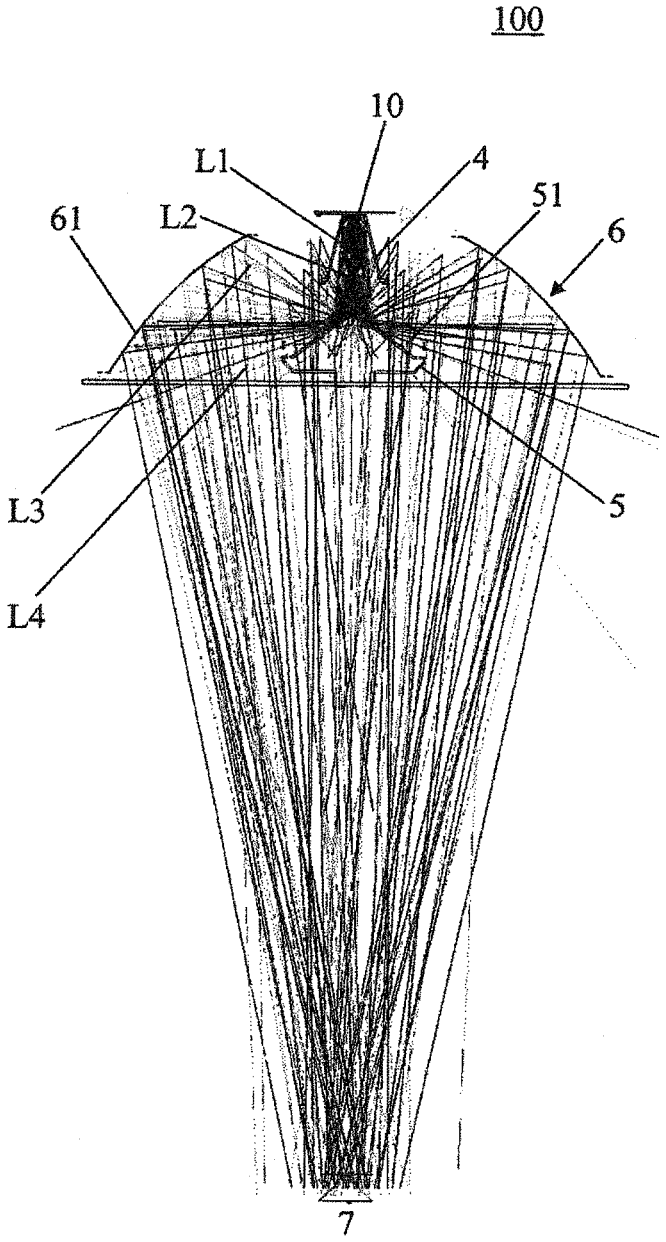
Figure 7C:
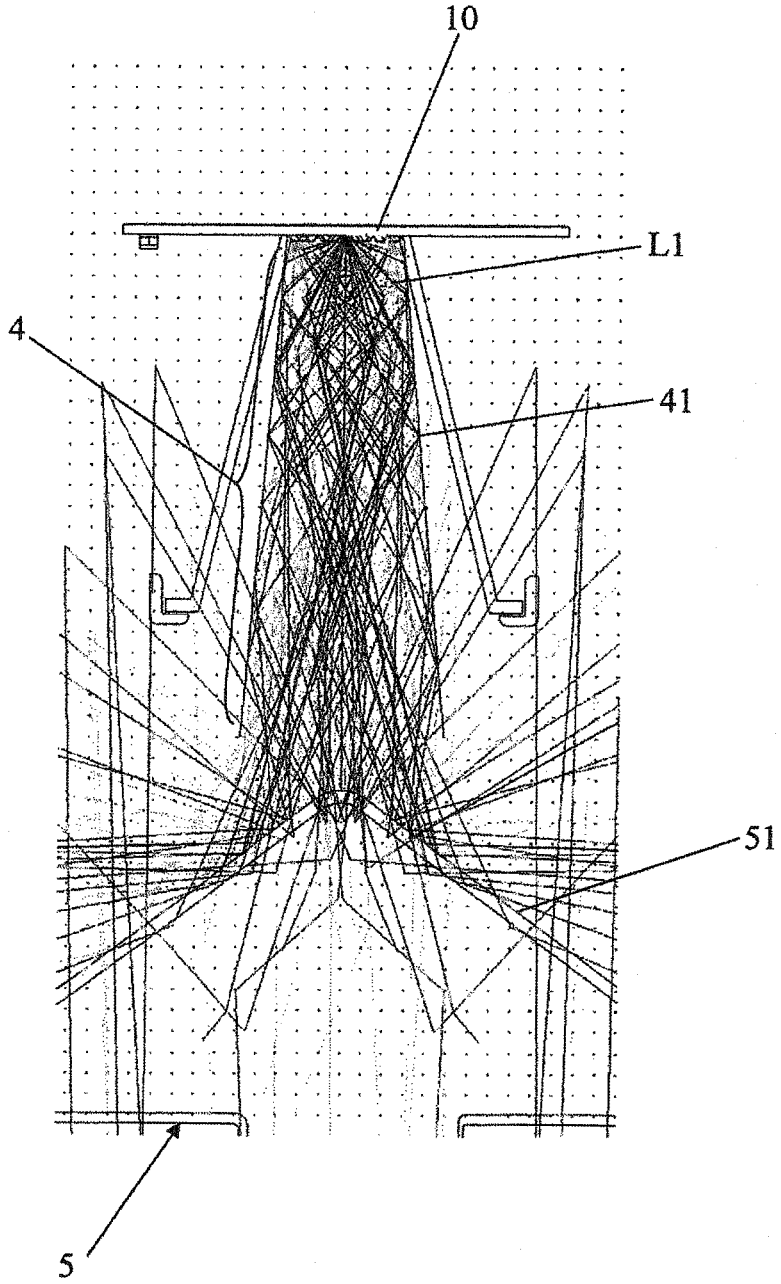
FIG. 7*c* is a diagram of an optical path from a light source to a first reflector of an illuminating device according to an embodiment.

FIG. 7*a* and FIG. 7*b* are diagrams of a general optical path of the illuminating device 100 according to one exemplary embodiment of the present invention. As shown in the figures, the light source unit 10 is arranged in the optical device 4. Emitted light L1, after reflected by the optical device 4 in the inner reflective surfaces 41, is incident upon the first reflector 5 in a form of light L2. The first reflector 5 has a conic-like outer reflective surface 51 by which light L2 is reflected to form light L3, and light L3 is incident upon the inner reflective surface 61 of the second reflector 6 and is formed into light L4 after reflected by the inner reflective surface 61 so as to form converged light that is focused onto a region 7 to be illuminated. The region 7 to be illuminated may be, for instance, a patient's body on an operation table. The second reflector 6 may be configured as a paraboloid type reflector. FIG. 7*c* is a diagram of an optical path from the light source unit 10 to the first reflector 5 of the illuminating device 100 according to one exemplary embodiment of the present invention. It can be seen more clearly from the figure that, for example, light L1, after emitted from the light source unit 10, is reflected and mixed several times in the optical device 4, and is finally input onto the outer reflective surface 51 of the conic-like first reflector 5.

LIST OF REFERENCE SIGNS

10 light source unit
100 illuminating device
1 vertical column
2 inner ring
3 outer ring
4 optical device
41 inner reflective surface
5 first reflector
51 outer reflective surface
6 second reflector
61 inner reflective surface
7 region to be illuminated
8 holding portion
11 PCB substrate
20 LED sub light source unit
L1-L4 light

What is claimed is:

1. A light source unit comprising at least one LED sub light source unit, wherein each LED sub light source unit comprises three types of LEDs:

phosphor converted green LED having CIE 1931 color location coordinates in the range x=0.35 to 0.39 and y=0.42 to 0.54, orange-red LED with a spectral emission in the wavelength range 614 nm to 622 nm and blue LED with a spectral emission in the wavelength range 460 nm to 476 nm, wherein each LED sub light source unit comprises 27 LEDs including 15 phosphor-converted green LEDs, seven orange-red LEDs and five blue LEDs, wherein the 27 LEDs are arranged as follows: a vertical column formed by three LEDs in a center, an inner ring surrounding the vertical column, and an outer ring surrounding the inner ring, and wherein the vertical column includes a phosphor-converted green LED in a middle, and a blue LED and an orange-red LED respectively on a top and at a bottom; eight phosphor-converted green LEDs are distributed on the inner ring with two green LEDs forming a row with the phosphor-converted green LED in the middle; and four blue LEDs, six green LEDs and six orange-red LEDs are distributed on the outer ring with one phosphor-converted green LED between two orange-red LEDs and one orange-red LED between two phosphor-converted green LEDs being arranged alternatively between each two blue LEDs.

2. The light source unit according to claim 1, wherein the three types of LEDs are arranged such that light is uniformly mixed in a whole CCT range of 3580K-5650K.

3. The light source unit according to claim 1, wherein the three types of LEDs are arranged such that light is uniformly mixed and the mixed light has a color rendering index of equal or greater than 90.

4. The light source unit according to claim 1, wherein each LED has a light emergent angle bigger than 140°.

5. The light source unit according to claim 1, wherein a maximum ratio of green luminous flux of the green LEDs can reach 90%, a maximum ratio of blue luminous flux of the blue LEDs can reach 10%, and a maximum ratio of orange-red luminous flux of the orange-red LEDs can reach 15%.

6. An illuminating device comprising the light source unit according to claim 1.

7. The illuminating device according to claim 6 further comprising an optical device, a first reflector and a second reflector, wherein light from the light source unit is incident upon the first reflector after mixed and collimated by the optical device, and incident upon the second reflector after reflected by the first reflector, to form a converged light column for a region to be illuminated after reflected by the second reflector.

8. The illuminating device according to claim 7, wherein the optical device is a total reflective collimating lens.

9. The illuminating device according to claim 7, wherein the optical device is a hollow reflection rod enclosing the light source unit.

10. The illuminating device according to claim 7, wherein the optical device is a hollow reflection rod enclosing the light source unit and having a hexagonal cross section.

11. The illuminating device according to claim 9, wherein the first reflector is downstream the optical device in a direction of optical axis of the light and is arranged to be opposite to the optical device.

12. The illuminating device according to claim 11, wherein the first reflector has a conic outer reflective surface rotationally symmetric with respect to the optical axis of the light, and a peak of the conic outer reflective surface is pointed to the light source unit.

13. The illuminating device according to claim 12, wherein the second reflector is a paraboloid reflector enclosing the first reflector.

14. Medical equipment equipped with the illuminating device according to claim 6.

* * * * *